US010130186B2

(12) United States Patent
Tong

(10) Patent No.: US 10,130,186 B2
(45) Date of Patent: Nov. 20, 2018

(54) HEIGHT ADJUSTABLE ARMREST

(71) Applicant: BLUMENTHAL DISTRIBUTING, INC., Ontario (CA)

(72) Inventor: Baijun Tong, Zhejiang (CN)

(73) Assignee: Blumenthal Distributing, Inc., Ontario (CA)

( * ) Notice: Subject to any disclaimer, the term of this patent is extended or adjusted under 35 U.S.C. 154(b) by 117 days.

(21) Appl. No.: 15/414,515

(22) Filed: Jan. 24, 2017

(65) Prior Publication Data

US 2017/0208951 A1 Jul. 27, 2017

(30) Foreign Application Priority Data

Jan. 25, 2016 (CN) ..... ZL2016 2 0068690

(51) Int. Cl.
*A47C 7/54* (2006.01)
*A47C 1/03* (2006.01)

(52) U.S. Cl.
CPC . *A47C 7/54* (2013.01); *A47C 1/03* (2013.01)

(58) Field of Classification Search
CPC ..... A47C 7/54; A47C 1/03
USPC ..... 297/411.36, 411.2, 411.25, 411.28, 297/411.32, 411.31, 411.35
See application file for complete search history.

(56) References Cited

U.S. PATENT DOCUMENTS 5,324,096 A * 6/1994 Schultz ..... A47C 1/03 297/353
5,393,125 A * 2/1995 Watson ..... A47C 1/03 248/118.3
5,839,786 A * 11/1998 Cvek ..... A47C 1/03 297/411.35
6,273,384 B1 * 8/2001 Hallmark ..... A47C 7/402 248/297.31
6,439,664 B1 * 8/2002 Gorgi ..... A47C 1/03 297/353
6,824,218 B1 * 11/2004 van Hekken ..... A47C 1/03 297/411.36
6,837,545 B1 * 1/2005 Ho ..... A47C 1/03 297/411.36
7,246,859 B2 * 7/2007 Igarashi ..... A47C 1/03 297/411.36
7,448,687 B2 * 11/2008 Tsai ..... A47C 1/03 297/411.35
7,556,316 B1 * 7/2009 Lai ..... A47C 1/03 297/411.2

(Continued)

*Primary Examiner* — Mark R Wendell
(74) *Attorney, Agent, or Firm* — Lewis Roca Rothgerber Christie LLP

(57) ABSTRACT

An adjustable armrest assembly including a base configured to be mounted on a side of seat, an armrest, and an adjustment assembly configured to adjustably couple the armrest to the base. The adjustment assembly includes first and second rows of grooves, an adjustment slot located between the first and second rows of grooves, a clip stopper configured to selectively engage the first and second rows of grooves, and a threaded stud coupling the clip stopper to the armrest. When the armrest is rotated in a first direction, teeth of the clip stopper disengage a first pair of grooves and permit the armrest to slide relative to the adjustment slot to adjust the armrest into a desired position. When the armrest is rotated in a second direction, the teeth of the clip stopper engage a second pair of grooves to set the armrest in the desired position.

20 Claims, 3 Drawing Sheets

(56) References Cited

U.S. PATENT DOCUMENTS

| | | | | |
|---|---|---|---|---|
| 7,611,206 | B2 * | 11/2009 | Tsai | A47C 1/03 297/411.36 |
| 7,828,390 | B2 * | 11/2010 | Liu | B60N 2/753 297/411.36 |
| 9,004,603 | B1 * | 4/2015 | Wang | A47C 1/03 297/411.35 |
| 2008/0309140 | A1 * | 12/2008 | Ho | A47C 1/03 297/411.36 |
| 2010/0060065 | A1 * | 3/2010 | Hung | A47C 1/03 297/378.1 |
| 2013/0033082 | A1 * | 2/2013 | Huang | A47C 1/03 297/411.36 |
| 2015/0115683 | A1 * | 4/2015 | Huang | A47C 1/03 297/411.36 |

* cited by examiner

HEIGHT ADJUSTABLE ARMREST

CROSS-REFERENCE TO RELATED APPLICATION

This application claims priority to and the benefit of Chinese Application No. ZL201620068690.9, filed Jan. 25, 2016, the entire content of which is incorporated herein by reference.

FIELD

The present disclosure relates to adjustable armrests.

BACKGROUND

Chairs are commonly provided with armrests for users to rest or support their arms in an ergonomic configuration and to aid the user in sitting and standing from the chair. Many conventional chairs are provided with fixed armrests that are not adjustable relative to a remainder of the chair (e.g., relative to a seat and/or a backrest of the chair). However, fixed armrests may be unsuitable for accommodating the needs of users of different statures (e.g., different heights).

Some conventional chairs are provided with adjustable armrests. However, many conventional adjustable armrests include a large number of components or otherwise have a complicated construction, which makes such conventional adjustable armrests costly, cumbersome to use, and/or prone to a high rate of failure.

SUMMARY

The present disclosure is directed to various embodiments of an adjustable armrest assembly. In one embodiment, the adjustable armrest assembly includes a base configured to be mounted on a side of seat, an armrest configured to be adjustably coupled to the base, and an adjustment assembly configured to adjustably couple the armrest to the base. The adjustment assembly includes a first row of grooves and a second row of grooves spaced apart from the first row of grooves, an adjustment slot located between the first and second rows of grooves, and a clip stopper configured to selectively engage the first and second rows of grooves. The clip stopper includes a first tooth configured to engage a groove in the first row of grooves and a second tooth configured to engage a corresponding groove in the second row of grooves. The adjustable armrest assembly also includes a threaded stud coupling the clip stopper to the armrest. When the armrest is coupled to the base by the adjustment assembly, the threaded stud extends through the adjustment slot and the clip stopper is between the first row of grooves and the second row of grooves. When the armrest is coupled to the base by the adjustment assembly and the armrest is rotated in a first direction, the first tooth and the second tooth of the clip stopper disengage a first pair of grooves in the first and second rows of grooves and permit the armrest to slide relative to the adjustment slot to adjust the armrest into a desired position. When the armrest is rotated in a second direction opposite the first direction, the first tooth and the second tooth of the clip stopper engage a second pair of grooves in the first and second rows of grooves to set the armrest in the desired position.

The adjustable armrest assembly may also include a clip locking part for securing the clip stopper to the threaded stud and a cover plate configured to conceal the clip locking part. The adjustable armrest assembly may also include a flexible spacer between the cover plate and the clip stopper. The cover plate may be round. The adjustable armrest assembly may also include a hole in the cover plate configured to receive the threaded stud and a nut configured to engage the threaded stud and tighten and compress the cover plate. The adjustable armrest assembly may also include an adjustment frame defining a window larger than the adjustment groove. The first and second rows of grooves may be located on opposite sides of the window. The adjustable armrest assembly may also include a first stop proximate to a first end of the adjustment groove and a second stop proximate to a second end of the adjustment groove opposite to the first end of the adjustment groove. The first and second stops may be flexible. The adjustable armrest assembly may also include a baffle plate facing the base when the armrest is coupled to the base by the adjustment assembly. The baffle plate is configured to contact the base when the armrest is rotated in the first direction to limit further rotation of the armrest.

The first tooth of the clip stopper may have a shape substantially corresponding to a shape of a groove in the first row of grooves and the second tooth of the clip stopper may have a shape substantially corresponding to a shape of a groove in the second row of grooves. Each of the grooves in the first row of grooves may have a first orientation and each of the grooves in the second row of grooves may have a second orientation opposite the first orientation. The first tooth of the clip stopper may have an orientation opposite to an orientation of the second tooth of the clip stopper. The first tooth of the clip stopper may have a downward-facing surface and each of the grooves of the first row of grooves may have an upward-facing surface configured to be engaged by the downward-facing surface of the first tooth. The second tooth of the clip stopper may have an upward-facing surface and each of the grooves in the second row of grooves may have a downward-facing surface configured to be engaged by the upward-facing surface of the second tooth.

This summary is provided to introduce a selection of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

The features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of an adjustable armrest assembly including a base configured to be coupled to a side of a chair and an armrest adjustably coupled to the base by an adjustment assembly. The height of the armrest according to one or more embodiments of the present disclosure may be adjusted by rotating the armrest in a first direction (e.g., rotating the armrest upward towards a vertical position), sliding the armrest upward or downward relative to the base and into the desired position, and then rotating the armrest in a second direction opposite to the first (e.g., rotating the armrest downward toward the horizontal position). The adjustment assembly according to one or more embodiments of the present disclosure has a relatively simple construction compared to conventional adjustable armrests, which may lead to increased durability and a reduced failure rate.

Figure 1:
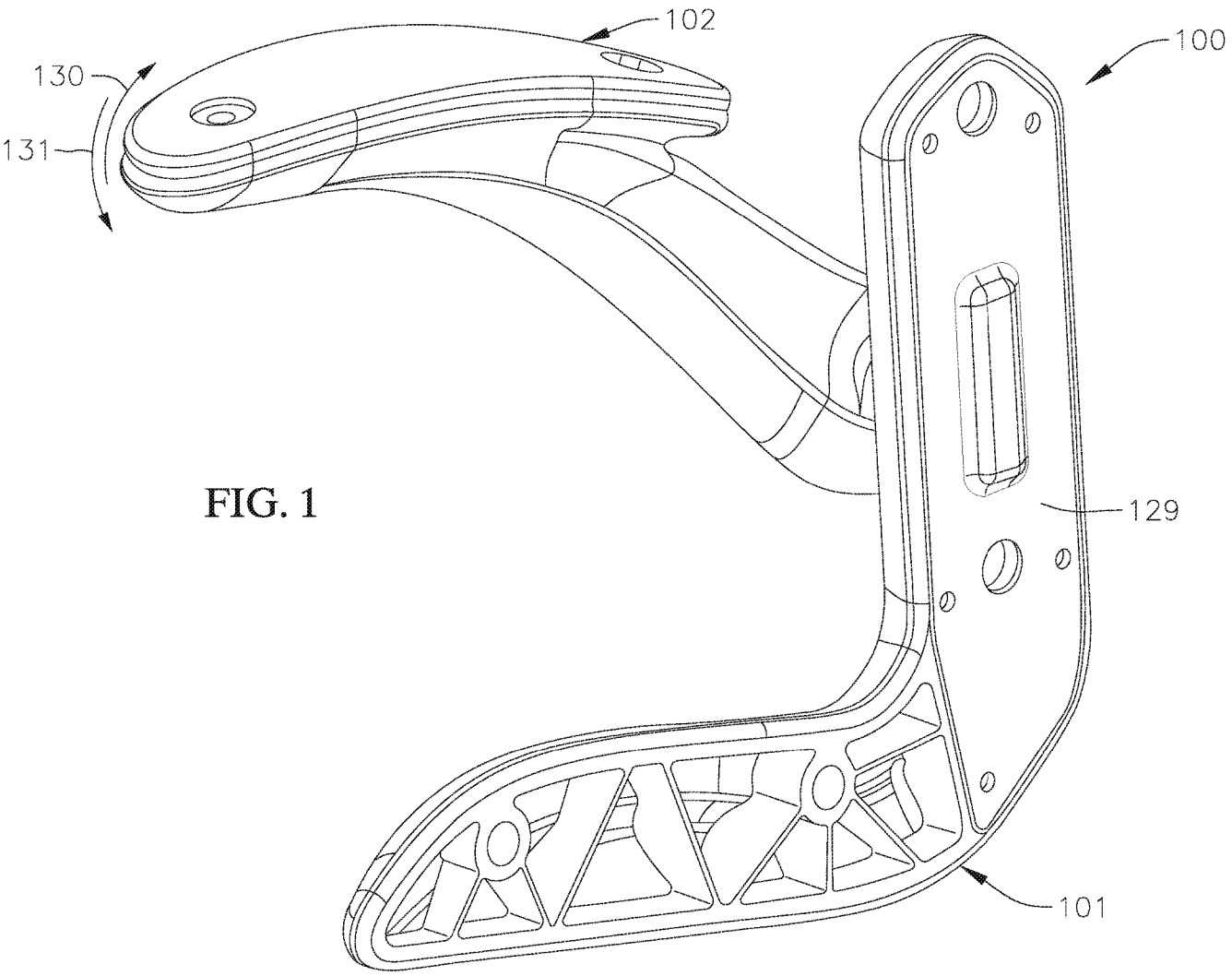
FIG. 1 is a perspective view of an adjustable armrest assembly according to one embodiment of the present disclosure.
Figure 2:
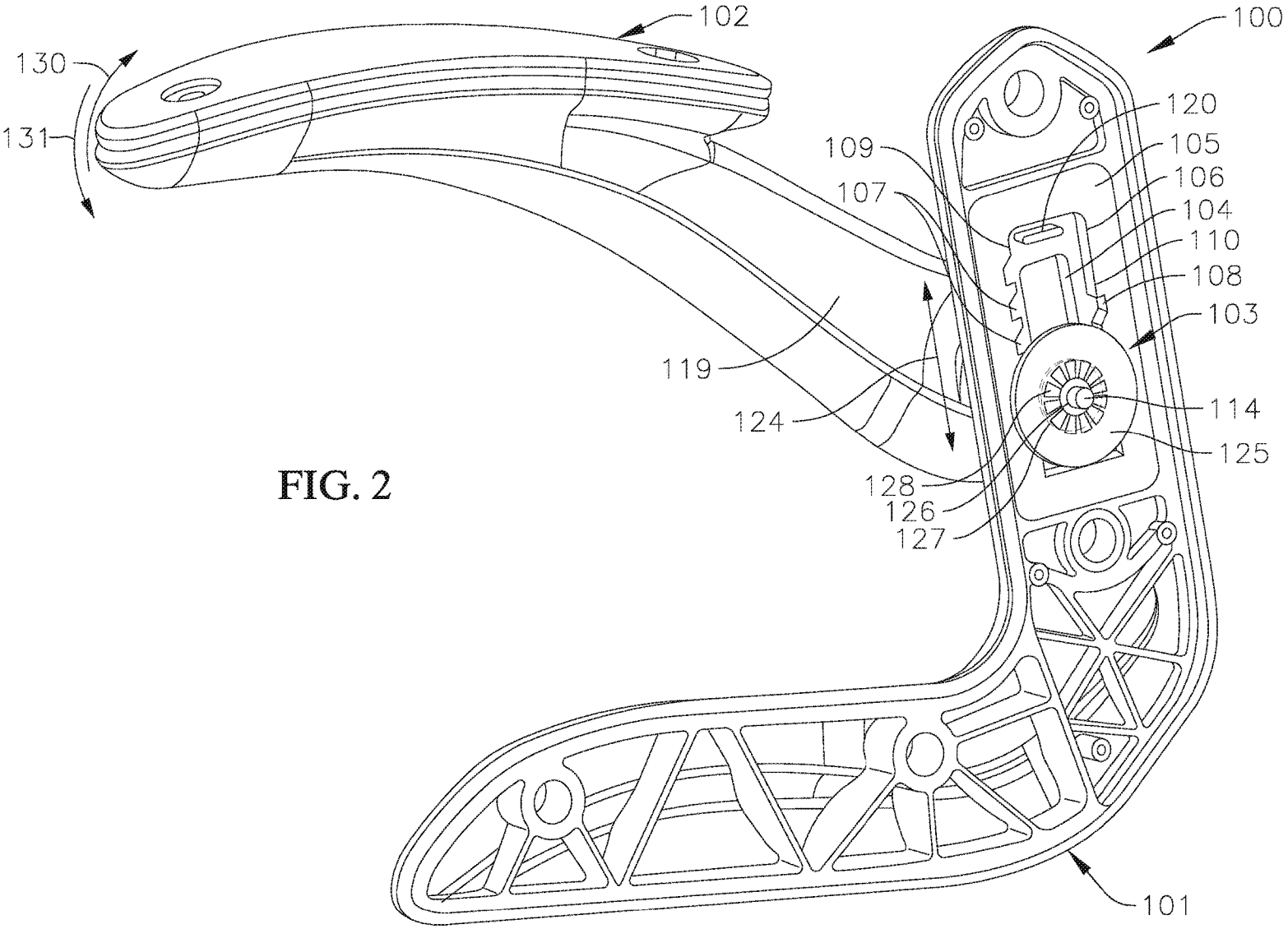
FIG. 2 is a perspective view of the embodiment of the adjustable armrest assembly of FIG. 1 with a base plate removed to reveal an adjustment assembly.
Figure 3:
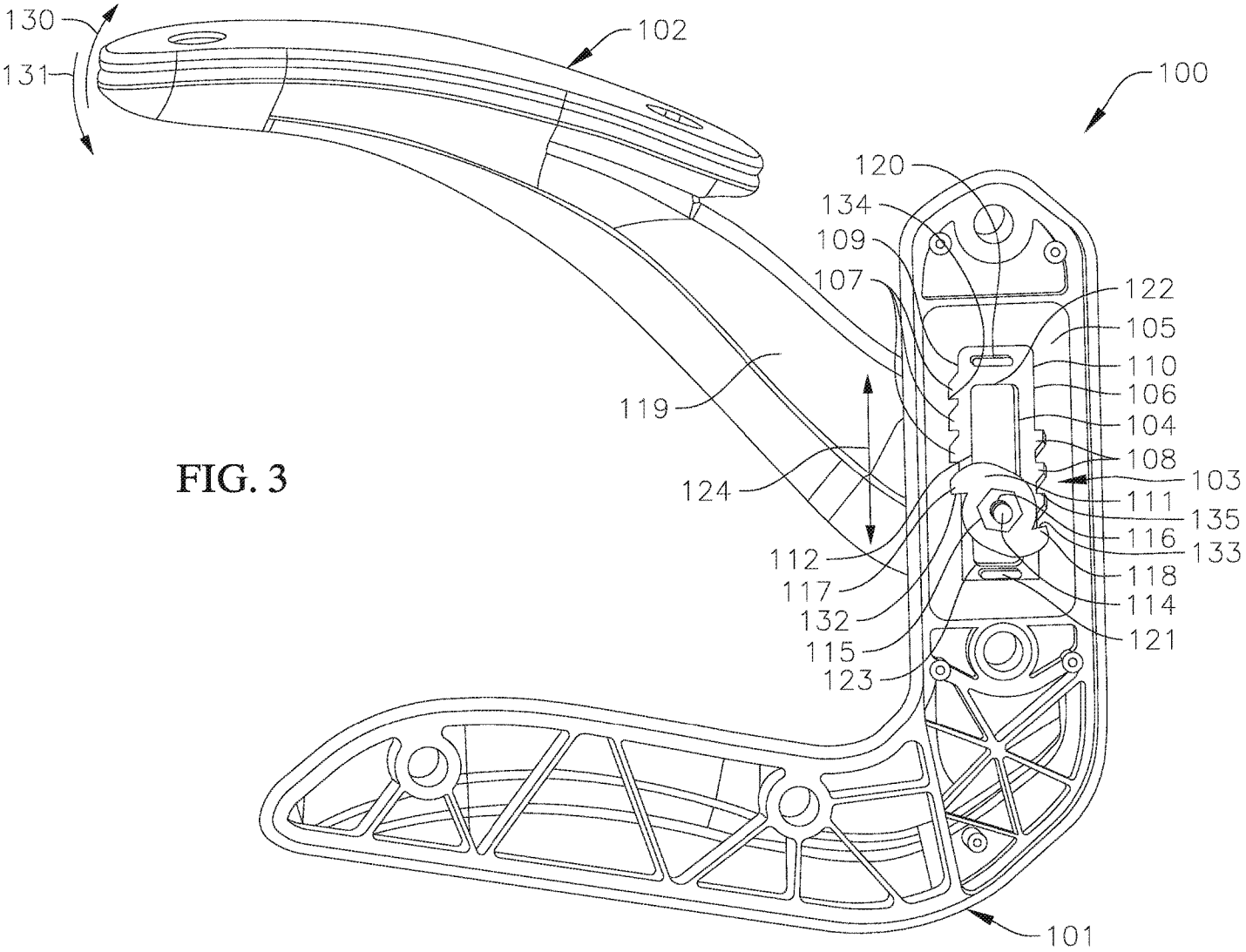
FIG. 3 is a perspective view of the embodiment of the adjustment armrest assembly of FIG. 2 with a cover plate removed to reveal additional components of the adjustment assembly.

With reference now to FIGS. 1-3, an adjustable armrest assembly 100 according to one embodiment of the present disclosure includes a base 101 configured to be coupled to a chair and an armrest 102 adjustably coupled to the base 101 by an adjustment assembly 103. In the illustrated embodiment, the adjustment assembly 103 includes an elongated adjustment slot 104 (e.g., a rectangular opening), an adjustment frame 105 coupled to the base 101 defining a window 106 (e.g., a rectangular opening) and two rows of grooves or notches 107, 108 defined along opposite sides 109, 110 of the window 106, respectively, and a clip stopper 111 (see FIG. 3) configured to selectively engage the grooves 107, 108 in the adjustment frame 105. In the illustrated embodiment, the window 106 defined in the adjustment frame 105 is larger than the elongated adjustment slot 104 (e.g., the window 106 is wider than the elongated adjustment slot 104). Additionally, in the illustrated embodiment, the elongated adjustment slot 104 is aligned with the window 106 defined in the adjustment frame 105 such that sides 112, 113 of the elongated adjustment slot 104 are between the sides 109, 110 of the window 106. In one or more embodiments, the elongated adjustment slot 104 may be defined in a separate component (e.g., a plate or bracket) coupled to the armrest 102, although in one or more embodiments the elongated adjustment slot 104 may be defined directly in the armrest 102.

With continued reference to the embodiment illustrated in FIGS. 1-3, the clip stopper 111 is coupled to the armrest 102 by a threaded stud 114 (e.g. a screw) and a clip locking part 115 (e.g., a nut) engaging the threaded stud 114. In the illustrated embodiment, the clip stopper 111 defines a hole 116 configured to receive the threaded stud 114 (e.g., the threaded stud 114 extends through the hole 116 in the clip stopper 111). When the armrest 102 is coupled to the base 101, the threaded stud 114 extends through the adjustment slot 104 and the window 106, and the clip stopper 111 is aligned with the window 106 (e.g., the clip stopper 111 is co-planar with the window 106 in the adjustment frame 105) such that the clip stopper 111 is between the two rows of grooves 107, 108 in the adjustment frame 105. Additionally, in the illustrated embodiment, the clip stopper 111 includes a first tooth 117 and a second tooth 118 to selectively engage one of the grooves in the first row of grooves 107 and a corresponding one of the grooves in the second row of grooves 108. In one or more embodiments, the shape of the teeth 117, 118 of the clip stopper 111 matches or substantially matches the shape of the grooves 107, 108 in the adjustment frame 105. In one or more embodiments, the shape of the teeth 117, 118 of the clip stopper 111 may be different than the shape of the grooves 107, 108 in the adjustment frame 105. Additionally, in the illustrated embodiment, the teeth 117, 118 of the clip stopper 111 are oriented in opposite directions (e.g., one of the teeth 117 has a downward-facing surface 132 and the other one of the teeth 118 includes an upward-facing surface 133) and the grooves 107, 108 in the adjustment frame 105 are oriented in corresponding opposite directions (e.g., the grooves 107 along one side 109 of the window 106 have upward-facing surfaces 134 configured to engage the downward-facing surface 132 of one of the teeth 117 of the clip stopper 111 and the grooves 108 along the other side 110 of the window 106 have downward-facing surfaces 135 configured to engage the upward-facing surface 133 of one of the teeth 118 of the clip stopper 111).

With continued reference to the embodiment illustrated in FIGS. 1-3, the armrest 102 also includes a baffle plate 119 facing the base 101 (e.g., when the base 101 of the adjustable armrest assembly 100 is coupled to a chair, the baffle plate 119 of the armrest 102 will face inward toward the chair). When the armrest 102 is rotated (e.g., clockwise in FIGS. 1-3 toward a vertical orientation), the baffle plate 119 is configured to engage or contact a portion of the base 101 to prevent further rotation of the armrest 102 (i.e. prevent over-rotation of the armrest 102 in the first direction). Otherwise, the armrest 102 could be rotated into an unusable orientation.

Additionally, in the embodiment illustrated in FIGS. 1-3, the adjustment assembly 103 also includes a first flexible stopper or limiter 120 (e.g., an upper flexible stopper) and a second flexible stopper or limiter 121 (e.g., a lower flexible stopper) spaced apart from the first flexible stopper 120. In the illustrated embodiment, the first flexible stopper 120 is proximate to a first end 122 of the elongated adjustment slot 104 and the second flexible stopper 121 is proximate to a second end 123 of the adjustment slot (e.g., the first flexible stopper 120 is spaced above an upper end 122 of the elongated adjustment slot 104 and the second flexible stopper 121 is spaced below a lower end 123 of the elongated adjustment slot 104). The first and second flexible stoppers 120, 121 are configured to limit the extent to which the armrest 102 may be slid (arrow 124) within the elongated adjustment slot 104 and to thereby prevent the threaded stud 114 from contacting the ends 122, 123 of the elongated adjustment slot 104. For example, in the illustrated embodiment, the clip stopper 111 is configured to contact the first flexible stopper 120 (e.g., the upper stopper) to limit the upward travel of the armrest 102 and the clip stopper 111 is configured to contact the second stopper 121 (e.g., the lower stopper) to limit the downward travel of the armrest 102 relative to the elongated adjustment slot 104. Otherwise, repeated contact between the threaded stud 114 and the 122, 123 of the elongated adjustment slot 104 could prematurely wear the elongated adjustment slot 104. Although in the illustrated embodiment the stoppers 120, 121 are flexible (e.g., made from a resilient material), in one or more embodiments the stoppers 120, 121 may be rigid or generally rigid.

As illustrated in FIG. 2, the adjustment assembly 103 also includes a cover plate 125 coupled to the threaded stud 114. The cover plate 125 is omitted in FIG. 3 to reveal other components of the adjustment assembly 103. In the illustrated embodiment, the cover plate 125 defines an opening 126 (e.g., a hole) configured to receive the threaded stud 114 (e.g., the threaded stud 114 is configured to extend through the opening 126 in the cover plate 125). Although in the illustrated embodiment the cover plate 125 is circular, in one or more embodiments the cover plate 125 may have any other suitable shape. In the illustrated embodiment, the cover plate 125 is on the clip locking part 115 (see FIG. 3). Additionally, in one or more embodiments, a spacer 127

(e.g., a flexible spacer) is provided between the cover plate 125 and the clip locking part 115. Additionally, in the illustrated embodiment, the adjustment assembly 103 includes a nut 128 engaging the threaded stud 114 to tighten and compress the cover plate 125 (e.g., the adjustment assembly 103 includes a nut 128 to tighten and compress the cover plate 125 against the clip locking part 115 or the spacer 127, if provided).

Additionally, in the illustrated embodiment, the adjustable armrest assembly 100 includes a base plate 129 (e.g., a base cover plate or bracket) configured to be detachably coupled to the base 101. As illustrated in FIG. 1, when the base plate 129 is attached to the base 101, the base plate 129 conceals the adjustment assembly 103. The base plate 129 is omitted in FIGS. 2 and 3 to reveal the components of the adjustment assembly 103.

In operation, when the armrest 102 is rotated in a first direction (arrow 130) (e.g., rotated clockwise in FIGS. 1-3 from a generally horizontal position toward a vertical position) the teeth 117, 118 of the clip stopper 111 disengage the grooves 107, 108 in the adjustment frame 105 (e.g., the downward-facing surface 132 of one of the teeth 117 of the clip stopper 111 disengages the upward-facing surface 134 of one of the grooves 107 along one side 109 of the window 106 and the upward-facing surface 133 of the other one of the teeth 118 of the clip stopper 111 disengages the downward-facing surface 135 of a corresponding one of the grooves 108 along the other side 110 of the window 106). When the teeth 117, 118 are disengaged from the grooves 107, 108, the armrest 102 may be slid (arrow 124) relative to the elongated adjustment slot 104 (e.g., the armrest 102, the clip stopper 111, the threaded stud 114, the clip locking part 115, and the cover plate 125 may be slid up or down relative to the elongated adjustment slot 104) into the desired position. Once the armrest 102 has been moved into the desired position relative to the base 101, the armrest 102 may be rotated in a second direction (arrow 131) opposite to the first direction (e.g., rotated counterclockwise in FIGS. 1-3 from an inclined position to the generally horizontal position). When the armrest 102 is rotated in the second direction (arrow 131), the teeth 117, 118 of the clip stopper 111 engage a pair of grooves 107, 108 in the adjustment frame 105 corresponding to the desired position of the armrest 102 (e.g., the downward-facing surface 132 of one of the teeth 117 of the clip stopper 111 engages the upward-facing surface 134 of one of the grooves 107 along one side 109 of the window 106 and the upward-facing surface 133 of the other one of the teeth 118 of the clip stopper 111 engages the downward-facing surface 135 of a corresponding one of the grooves 108 along the other side 110 of the window 106). The engagement between the teeth 117, 118 of the clip stopper 111 and the grooves 107, 108 in the adjustment frame 105 is configured to maintain the armrest 102 in the desired position until the user desires to adjust the position of the armrest 102 in the manner described above. In this manner, the position of the armrest 102 may be readily adjusted by rotating (arrow 130) the armrest 102 and sliding (arrow 124) the armrest 102 up or down into the desired position. Accordingly, when the base 101 of the adjustable armrest assembly 100 is coupled to a chair, the armrest 102 may be adjusted relative to the base 101 to adjust a height of the armrest 102 and thereby accommodate users with different preferences and/or different statures (e.g., a height of the armrest 102 relative to a seat portion of the chair may be adjusted to accommodate users with different heights and/or different preferences).

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "upper," "lower," "below," and "above," and similar terms have been used herein to describe a spatial relationship of one element to another, it is understood that these terms are intended to encompass different orientations of the various elements and components of the device in addition to the orientation depicted in the figures. Additionally, as used herein, the terms "substantially," "generally," and similar terms are used as terms of approximation and not as terms of degree, and are intended to account for the inherent deviations in measured or calculated values that would be recognized by those of ordinary skill in the art.

What is claimed is:

1. An adjustable armrest assembly, comprising:

a base configured to be mounted on a side of seat;

an armrest configured to be adjustably coupled to the base; and an adjustment assembly configured to adjustably couple the armrest to the base, the adjustment assembly comprising:

a first row of grooves and a second row of grooves spaced apart from the first row of grooves;

an adjustment slot located between the first and second rows of grooves;

a clip stopper configured to selectively engage the first and second rows of grooves, the clip stopper comprising a first tooth configured to engage a groove in the first row of grooves and a second tooth configured to engage a corresponding groove in the second row of grooves; and a threaded stud coupling the clip stopper to the armrest, wherein, when the armrest is coupled to the base by the adjustment assembly, the threaded stud extends through the adjustment slot and the clip stopper is between the first row of grooves and the second row of grooves, and wherein, when the armrest is coupled to the base by the adjustment assembly and the armrest is rotated in a first direction, the first tooth and the second tooth of the clip stopper disengage a first pair of grooves in the first and second rows of grooves and permit the armrest to slide relative to the adjustment slot to adjust the armrest into a desired position, and when the armrest is rotated in a second direction opposite the first direction, the first tooth and the second tooth of the clip stopper engage a second pair of grooves in the first and second rows of grooves to set the armrest in the desired position.

2. The adjustable armrest assembly of claim 1, further comprising:

a clip locking part for securing the clip stopper to the threaded stud; and a cover plate configured to conceal the clip locking part.

3. The adjustable armrest assembly of claim 2, further comprising a flexible spacer between the cover plate and the clip stopper.

4. The adjustable armrest assembly of claim 2, wherein the cover plate is round.

5. The adjustable armrest assembly of claim 2, further comprising:

a hole in the cover plate configured to receive the threaded stud; and a nut configured to engage the threaded stud and tighten and compress the cover plate.

6. The adjustable armrest of claim 1, wherein adjustment assembly further comprises an adjustment frame defining a window larger than the adjustment groove, and wherein the first and second rows of grooves are located on opposite sides of the window.

7. The adjustable armrest of claim 1, wherein the adjustment assembly further comprises a first stop proximate to a first end of the adjustment groove and a second stop proximate to a second end of the adjustment groove opposite to the first end of the adjustment groove.

8. The adjustable armrest of claim 7, wherein the first and second stops are flexible.

9. The adjustable armrest of claim 1, wherein the armrest further comprises a baffle plate facing the base when the armrest is coupled to the base by the adjustment assembly, and wherein the baffle plate is configured to contact the base when the armrest is rotated in the first direction to limit further rotation of the armrest.

10. The adjustable armrest of claim 1, wherein the first tooth of the clip stopper has a shape substantially corresponding to a shape of a groove in the first row of grooves and the second tooth of the clip stopper has a shape substantially corresponding to a shape of a groove in the second row of grooves.

11. The adjustable armrest of claim 1, wherein each of the grooves in the first row of grooves has a first orientation and each of the grooves in the second row of grooves has a second orientation opposite the first orientation.

12. The adjustable armrest of claim 11, wherein the first tooth of the clip stopper has an orientation opposite to an orientation of the second tooth of the clip stopper.

13. The adjustable armrest of claim 12, wherein the first tooth of the clip stopper has a downward-facing surface and each of the grooves of the first row of grooves has an upward-facing surface configured to be engaged by the downward-facing surface of the first tooth.

14. The adjustable armrest of claim 13, wherein the second tooth of the clip stopper has an upward-facing surface and each of the grooves in the second row of grooves has a downward-facing surface configured to be engaged by the upward-facing surface of the second tooth.

15. A chair, comprising:

a seat; and an adjustable armrest assembly coupled to the seat, the adjustable armrest assembly comprising:

a base mounted on a side of the seat;

an armrest adjustably coupled to the base; and an adjustment assembly adjustably coupling the armrest to the base, the adjustment assembly comprising:

a first row of grooves and a second row of grooves spaced apart from the first row of grooves;

an adjustment slot located between the first and second rows of grooves;

a clip stopper configured to selectively engage the first and second rows of grooves, the clip stopper comprising a first tooth configured to engage a groove in the first row of grooves and a second tooth configured to engage a corresponding groove in the second row of grooves; and a threaded stud coupling the clip stopper to the armrest, wherein, the threaded stud extends through the adjustment slot and the clip stopper is between the first row of grooves and the second row of grooves, and wherein, when the armrest is rotated in a first direction, the first tooth and the second tooth of the clip stopper disengage a first pair of grooves in the first and second rows of grooves and permit the armrest to slide relative to the adjustment slot to adjust the armrest into a desired height relative to the seat, and when the armrest is rotated in a second direction opposite the first direction, the first tooth and the second tooth of the clip stopper engage a second pair of grooves in the first and second rows of grooves to set the armrest in the desired height.

16. The chair of claim 15, wherein adjustment assembly further comprises an adjustment frame defining a window larger than the adjustment groove, and wherein the first and second rows of grooves are located on opposite sides of the window.

17. The chair of claim 15, wherein the adjustment assembly further comprises a first stop proximate to a first end of the adjustment groove and a second stop proximate to a second end of the adjustment groove opposite to the first end of the adjustment groove.

18. The chair of claim 15, wherein the armrest further comprises a baffle plate facing the base, and wherein the baffle plate is configured to contact the base when the armrest is rotated in the first direction to limit further rotation of the armrest.

19. The chair of claim 15, wherein each of the grooves in the first row of grooves has a first orientation and each of the grooves in the second row of grooves has a second orientation opposite the first orientation.

20. The chair of claim 19, wherein the first tooth of the clip stopper has an orientation opposite to an orientation of the second tooth of the clip stopper.

* * * * *